US008292446B2

(12) United States Patent
Fujihara et al.

(10) Patent No.: US 8,292,446 B2
(45) Date of Patent: Oct. 23, 2012

(54) ILLUMINATION DEVICE FOR MULTINEEDLE SEWING MACHINE AND THE MULTINEEDLE SEWING MACHINE

(75) Inventors: Shinya Fujihara, Ichinomiya (JP); Yasuhiro Ishiyama, Nagoya (JP); Nobuaki Matsumoto, Nagoya (JP); Junnosuke Matsuda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 435 days.

(21) Appl. No.: 12/659,300

(22) Filed: Mar. 3, 2010

(65) Prior Publication Data

US 2010/0242820 A1 Sep. 30, 2010

(30) Foreign Application Priority Data

Mar. 27, 2009 (JP) ..... 2009-079169

(51) Int. Cl.
*D05B 79/00* (2006.01)

(52) U.S. Cl. ..... 362/90; 362/89; 362/33; 362/249.01; 362/249.02; 362/249.03; 362/249.1

(58) Field of Classification Search ..... 362/89, 362/90, 33, 249.01–249.03, 249.1; 112/27
See application file for complete search history.

(56) References Cited

U.S. PATENT DOCUMENTS 6,527,403 B2 * 3/2003 Manuel ..... 362/90
6,796,256 B2 * 9/2004 Seibert et al. ..... 112/270
6,832,841 B2 * 12/2004 Kitakata ..... 362/90

FOREIGN PATENT DOCUMENTS

JP A-5-337271 12/1993
JP A-11-221394 8/1999
JP A-11-253685 9/1999

* cited by examiner

*Primary Examiner* — Ali Alavi
(74) *Attorney, Agent, or Firm* — Oliff & Berridge, PLC

(57) ABSTRACT

An illumination device for a multineedle sewing machine includes an illuminating member which has a light source and located at a lateral side of a needle bar case and is disposed so as to open portions of needle bars and portions of needles, a light amount adjusting unit which adjusts an amount of light of the light source, and a control unit which controls the light amount adjusting unit with movement of the needle bar case by the needle bar case moving mechanism together with the illuminating member so that a predetermined illuminance is maintained at least in part of an illuminated area which is illuminated by the light source. The part of the illuminated area is located near the needle drop position.

5 Claims, 14 Drawing Sheets

WHERE

—■— : CURRENT VALUE OF LEFT LAMP 27a

—▲— : CURRENT VALUE OF RIGHT LAMP 27b

—○— : ILLUMINANCE NEAR NEEDLE EYE

ILLUMINATION DEVICE FOR MULTINEEDLE SEWING MACHINE AND THE MULTINEEDLE SEWING MACHINE

CROSS-REFERENCE TO RELATED APPLICATIONS

This application is based on and claims the benefit of priority from the prior Japanese Patent Application No. 2009-79169, filed on Mar. 27, 2009, the entire contents of which are incorporated herein by reference.

BACKGROUND

1. Field

The present disclosure relates to an illumination device for a multineedle sewing machine provided with a plurality of needle bars having lower ends to which needles are attached, respectively, a needle bar case which supports the needle bars so that the needle bars are movable upward and downward and a needle bar case moving mechanism which selectively switches one of the needle bars to a needle drop position, and the multineedle sewing machine provided with the illumination device.

2. Related Art

There have conventionally been provided multineedle sewing machines of the above-described type which include an illumination device for illuminating a needle base of each needle or a surface of workpiece cloth. For example, a fluorescent lamp serving as the illumination device is mounted on an underside of a needle bar case so as to hang forward along juxtaposed needle bars, whereupon the needle base of each needle bar is adapted to be sufficiently illuminated by the fluorescent lamp. The side where the user is located and views the needle bar case moving in the right-left direction is referred to as "front side" (outer peripheral side).

Furthermore, one of the above-described types of multineedle sewing machines is provided with a magnifying lens which is used to magnify a part of needle thread to be passed through an eye of needle so that the user views a magnified image and an illumination device which illuminates the aforesaid part of needle thread. The illumination device and the magnifying lens are disposed at the peripheral side near the needles along the arranged needles. As a result, the part of needle thread can be magnified and viewed while being directly illuminated by the illumination device.

However, the illumination device such as the fluorescent lamp is located at the peripheral side of each needle bar and thread passage (a path of thread drawn from a thread spool to a needle) in the above-described two types of multineedle sewing machines. Accordingly, each type of the above-described multineedle sewing machine has a problem that the illumination device hinders the hooking of needle thread or exchange of needles.

Furthermore, the needle bar case is slid in the right-left direction by the aforesaid needle bar case moving mechanism. Accordingly, the sliding movement of the needle bar case accompanies movement of the illumination device fixed to the needle bar case side in the same direction. As a result, an area illuminated by the illumination device is shifted from the needle drop position with movement of the needle bar case in the right-left direction relative to the sewing machine body. This reduces illuminance at the needle drop position.

SUMMARY

Therefore, an object of the present disclosure is to provide an illumination device for a multineedle sewing machine, in which an illuminating member can be prevented from hindering the hooking of needle thread or the like and a predetermined illuminance can be maintained at the needle drop position irrespective of movement of the needle bar case.

The present disclosure provides an illumination device for a multineedle sewing machine which includes a plurality of needle bars having lower ends to which needles are adapted to be attached respectively and a needle bar case supporting the needle bars so that the needle bars are movable upward and downward, and a needle bar case moving mechanism which moves the needle bar case so that one of the needle bars is selectively switched into a needle drop position, the needle bar case having a side formed along a moving direction thereof. The illumination device comprises an illuminating member having a light source and provided at a lateral side of the needle bar case, the illuminating member being disposed so as to open portions of the needle bars and portions of the needles, both portions being located at said side of the needle bar case respectively; a light amount adjusting unit which adjusts an amount of light emitted from the light source; and a control unit which controls the light amount adjusting unit with movement of the needle bar case by the needle bar case moving mechanism together with the illuminating member so that a predetermined illuminance is maintained at least in part of an illuminated area which is illuminated by the light source, said part of the illuminated area being located near a needle drop position.

DETAILED DESCRIPTION

Figure 1:
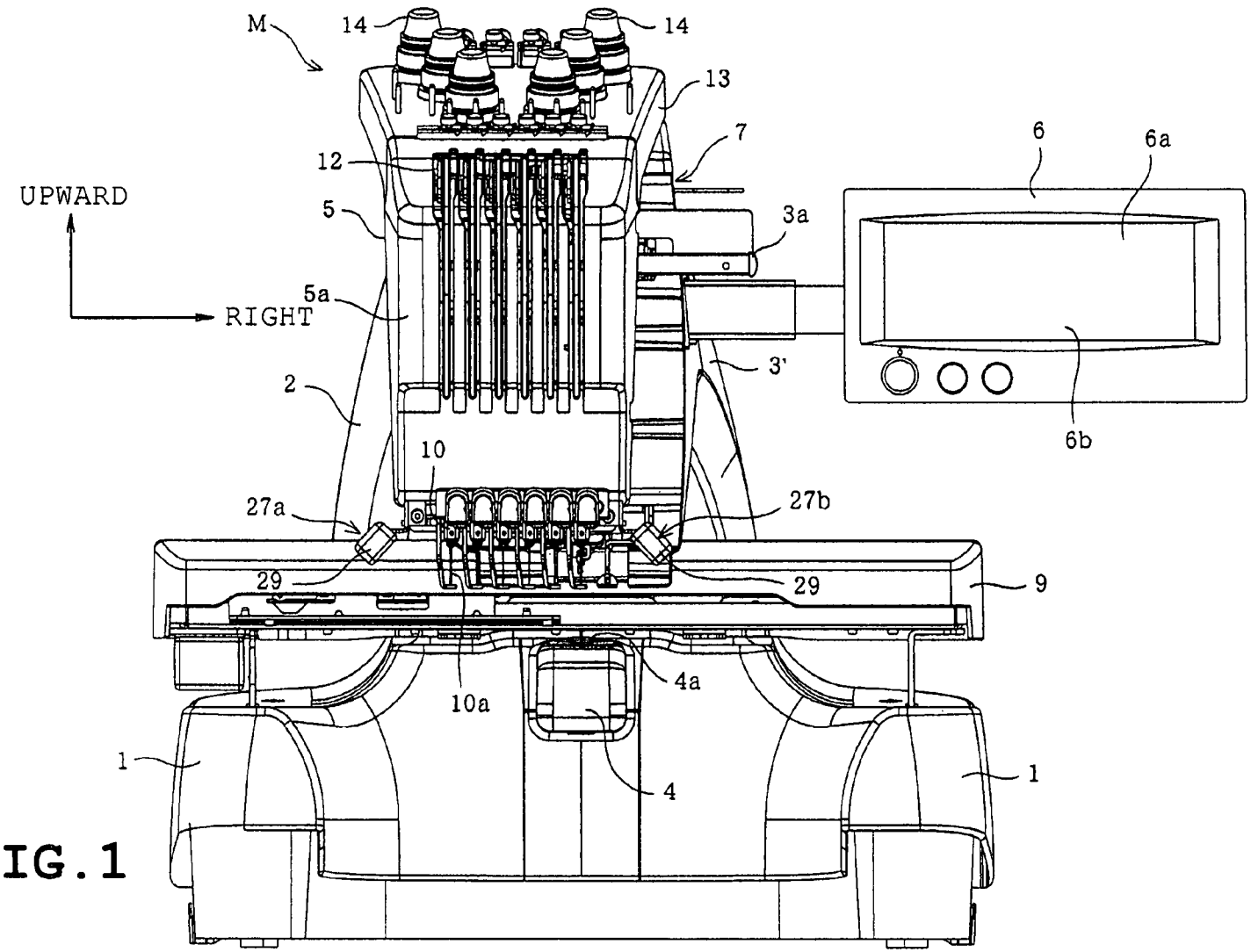
FIG. 1 is a front view of a multineedle sewing machine provided with an illumination device in accordance with one embodiment.

A first embodiment will be described with reference to FIGS. 1 to 8 of the accompanying drawings. The first embodiment is directed to a multineedle embroidery sewing machine which will hereinafter be referred to as "multineedle sewing machine M." Referring to FIG. 1, the overall multineedle sewing machine M is shown as viewed at the side of the user located in front of the multineedle sewing machine M. The side where the user is located will be referred to as "front side."

The multineedle sewing machine M includes a pair of right and left legs 1 supporting the overall sewing machine M, a support column 2 standing on rear ends of the legs 1, an arm 3 extending ahead of an upper part of the support column 2, a cylinder bed 4 extending ahead of a lower end of the support column 2, and a needle bar case 5 attached to a front end of the arm 3.

The legs 1, support column 2, arm 3 and cylinder bed 4 are formed integrally into a sewing machine body 7. At the sewing machine body 7 side are provided a control device 8 (see FIG. 6) serving as a control unit which controls the overall multineedle sewing machine M, an operation panel 6 and the like. A needle plate 4*a* (as shown only in FIG. 1) is mounted on an upper surface of the cylinder bed 4. The needle plate 4*a* has a needle hole P serving as a needle drop position of a needle 10*a* as will be described later.

A carriage 9 directed in the right-left direction is disposed above the legs 1. An X-direction drive mechanism (not shown) is provided inside the carriage 9 to drive a frame mounting (not shown) in the X direction (the right-left direction). A Y-direction drive mechanism is provided inside the legs 1 to drive the carriage 9 in the Y direction (the front-back direction). The frame mounting is located in front of the carriage 9. A rectangular embroidery frame (not shown) holds a workpiece cloth on which embroidery is to be sewn. The embroidery frame is to be mounted on the frame mounting. The carriage 9 is driven in the Y direction by the Y-direction drive mechanism, and the frame mounting is driven in the X direction by the X-direction drive mechanism as described above. Accordingly, the embroidery frame is moved in the Y direction in synchronization with the carriage 9 and in the X direction with the frame mounting, whereby the workpiece cloth is fed.

A spool pin holder is mounted on the sewing machine body 7 so as to be located above the arm 3 although not shown. Six spool pins (not shown) stand on the spool pin holder. Six thread spools are attached to the spool pins respectively. Furthermore, a guide rail 3*a* extending in the right-left direction is mounted on a front end of the arm 3. The aforesaid needle bar case 5 is supported on the guide rail 3*a* so as to be slid along the guide rail.

Six needle bars 10 are arranged in the right-left direction so as to extend in the up-down direction in the needle-bar case 5 and supported so as to be movable upward and downward. Six needles 10*a* to 10*f* are attached to lower ends of the needle bars 10 respectively. Six thread take-up levers 12 corresponding to the respective needle bars 10 are also provided in the needle-bar case 5 so as to be movable upward and downward. A cover 5*a* made of a synthetic resin is mounted on a front side of the needle-bar case 5. A thread tension bracket 13 inclined forwardly downward is mounted on the upper surface of the needle-bar case 5 so as to be continuous to the upper end of the cover 5*a*. Six thread tensioners 14 mounted on the thread tension bracket 13 to adjust tensions of upper threads supplied to the needles 10*a* respectively. The upper threads extending from the thread spools on the spool pins are hooked on the corresponding thread tensioners 14, thread take-up levers 12 and the like, thereafter being supplied to eyes (not shown) of the needles 10*a*, respectively.

The needle bar case 5 has opposite lateral sides which are perpendicular to the direction in which the needle bar case 5 is moved. The needle bar case 5 further has an outer side or front which extends substantially in parallel to the direction in which the needle bar case 5 is moved, as shown in FIG. 1. The thread take-up levers 12 are exposed from the needle bar case 5 at the outer side of the needle bar case 5, that is, at the side of the needle bar case 5 confronting a thread path of the multineedle sewing machine. The hooking of the upper threads along the thread path and the exchange of the needles 10 can be carried out at the outer side of the needle bar case 5.

Figure 2:
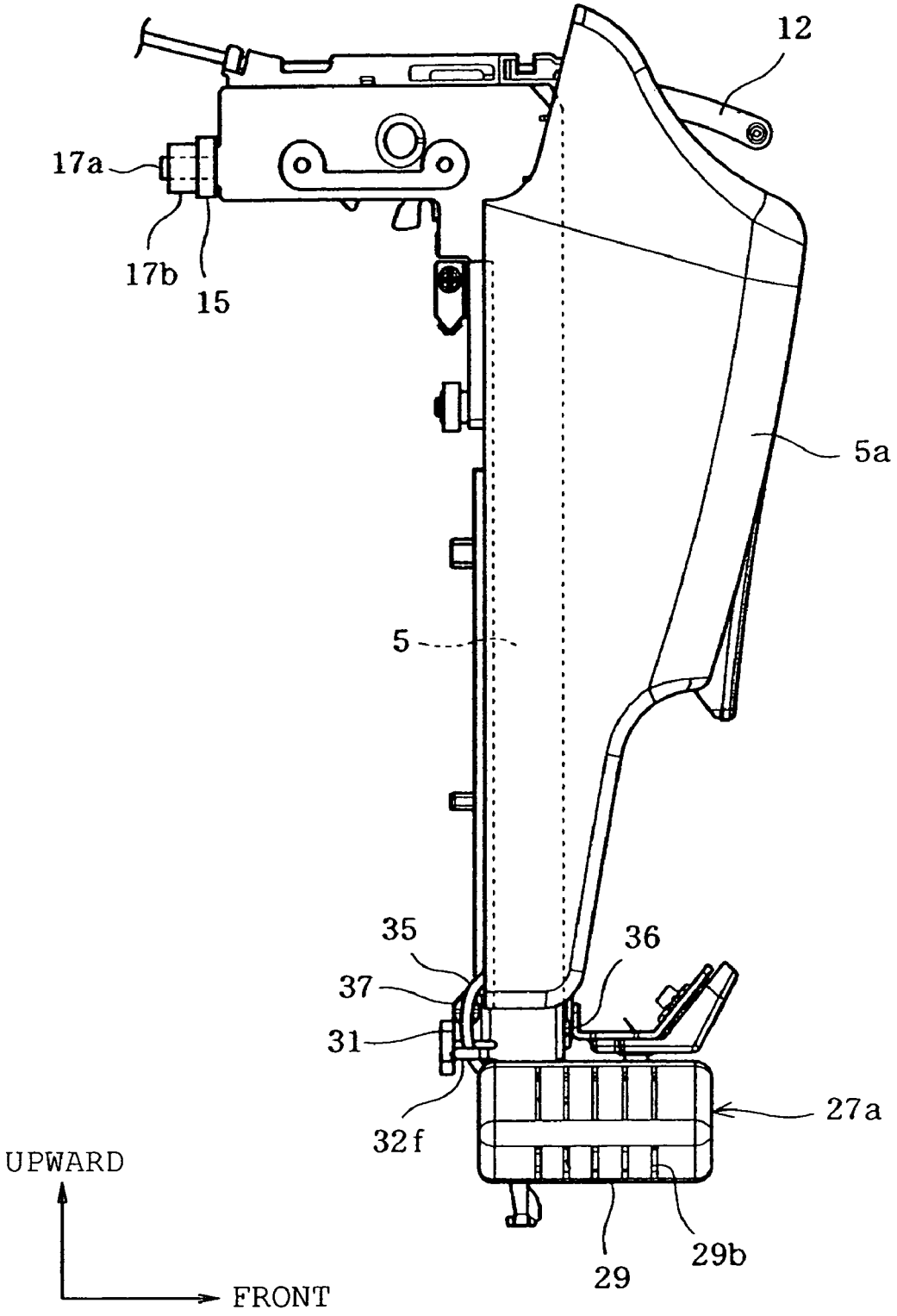
FIG. 2 is a side view of the illumination device and a needle bar case.
Figure 3:
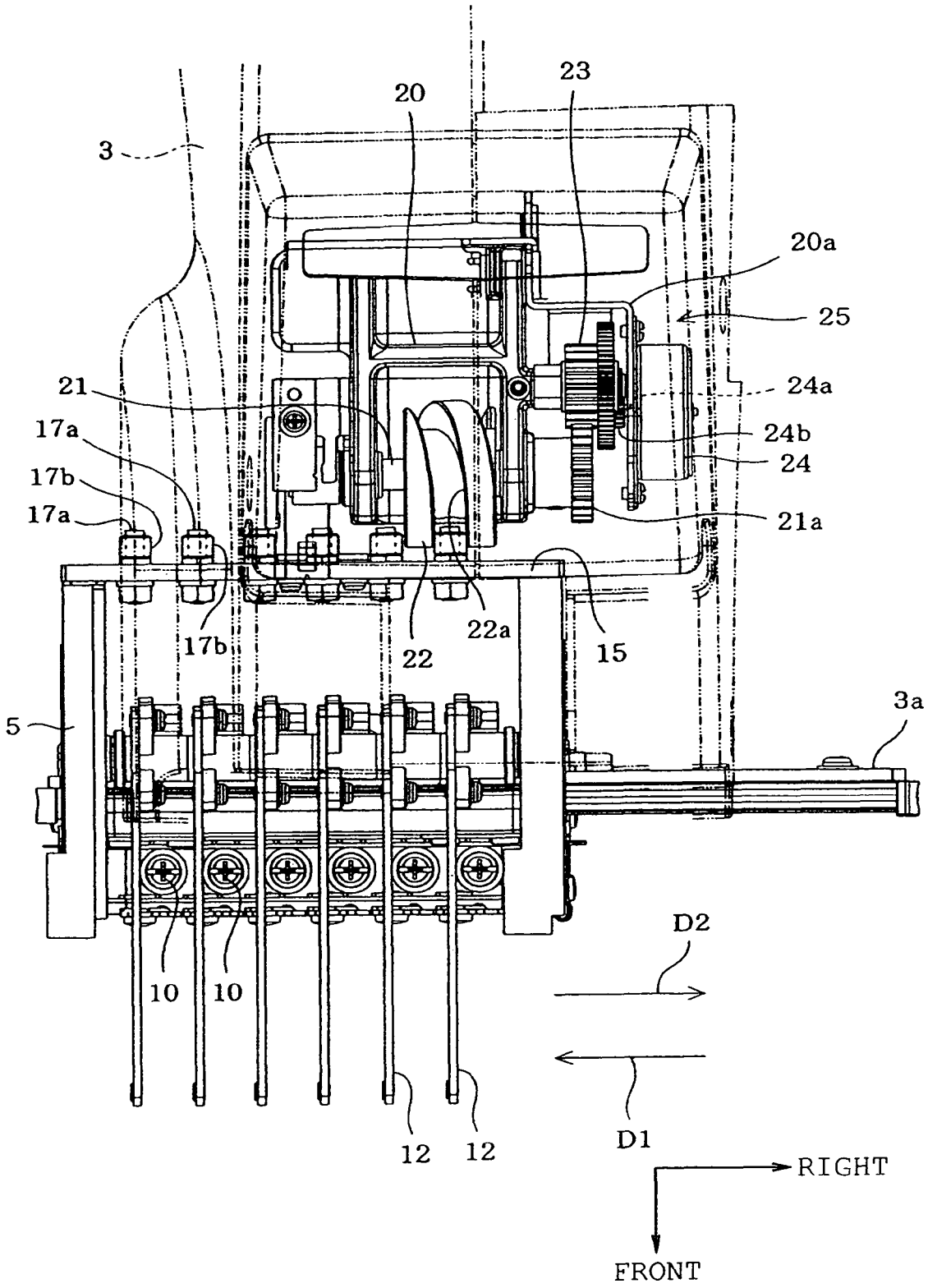
FIG. 3 is a plan view of the inner structure of the multineedle sewing machine near the needle bar case.
Figure 4:
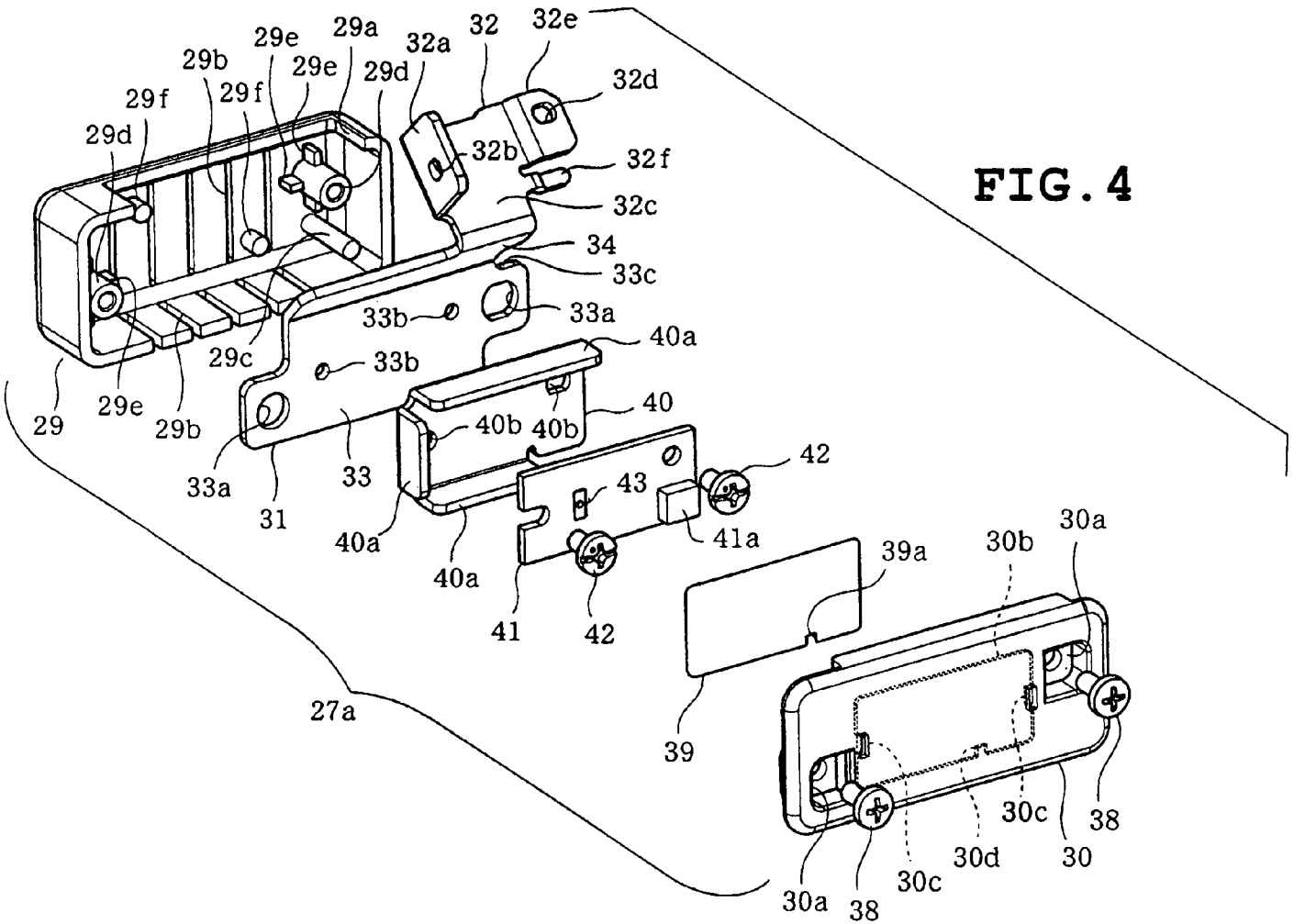
FIG. 4 is an exploded perspective view of the illumination device located at an illuminating position.

The needle bar case 5 is formed substantially into an inverted L-shape in a side view and has an upper rear end on which is provided a roller bearing mounting plate 15 extending in the right-left direction, as shown in FIG. 2. Six roller bearings 17*a* corresponding to six needle bars 10 are mounted on the mounting plate 15 at the same pitch as the needle bars 10, as shown in FIG. 3. The roller bearings 17*a* protrude in the front-back direction, and cylindrical rollers 17*b* are rotatably provided in the rear of the roller bearings 17*a* respectively.

A rotating shaft 21 extending in the right-left direction is rotatably mounted on a sewing machine frame in the arm 3 at the sewing machine body 7 side. The sewing machine frame is formed into a general H-shape in a plan view and will hereinafter be referred to as "fixed frame 20." A helical cam 22 having a helical cam surface 22*a* is secured to an axial middle of the rotating shaft 21. The helical cam surface 22*a* of the helical cam 22 is engageable with one of the rollers 17*b*. A gear 21*a* is secured to a right end of the rotating shaft 21. A crank-like auxiliary frame 20*a* is fixed to a right side of the fixed frame 20. A reduction gear mechanism 23 is provided between the fixed frame 20 and the auxiliary frame 20*a*. The reduction gear mechanism 23 is brought into mesh engagement with the gear 21*a*. A needle bar case moving electric motor 24 comprising a stepping motor is fixed to a right side of the auxiliary frame 20*a*. The motor 24 has a rotational shaft 24*a* extending through the auxiliary frame 20*a* and having a distal end with a gear 24*b* which is brought into mesh engagement with the reduction gear mechanism 23.

Upon normal or reverse rotation of the needle bar case moving motor 24, the rotational movement is transmitted via the reduction gear mechanism 23 to the rotational shaft 21, rotating the helical cam 22. With rotation of the helical cam 22, one of the rollers 17*b* in engagement with the cam surface 22*a* is switched sequentially to the subsequent rollers 17*b* from the left side to the right side or from the right side to the left side, so that the needle bar case 5 is moved leftward (in the direction of arrow D1 in FIG. 3) or rightward (in the direction of arrow D2 in FIG. 3). A needle bar case moving mechanism 25 is thus constituted by the rotational shaft 21, helical cam 22, reduction gear mechanism 23, gears 21*a* and 24*b*, needle bar case moving mechanism and the like as well as the roller shafts 17*a* and the rollers 17*b*. When the needle bar case 5 is moved reciprocally in the right-left direction relative to the sewing machine body 7 by the needle bar case moving mechanism 25, one of six sets of needle bars 10 and thread take-up levers 12 is selectively switched into the needle drop position (a use position). The selected needle bar 10 and thread take-up lever 12 are synchronously moved upward and downward by a sewing machine motor 26 (see FIG. 6) provided in the support column 2. Furthermore, embroidery stitches are formed on a workpiece cloth held on the embroidery frame by the selected needle bar 10 and thread take-up lever 12 in cooperation with a rotary hook (not shown) provided on a front end of the cylinder bed 4. When the rightmost needle bar 10 has been selected, the needle bar case 5 is moved to a leftmost position as shown in FIG. 3. When the leftmost needle bar 10 has been selected, the needle bar case 5 is moved to a rightmost position. The needle bar case 5 is reciprocally moved between the rightmost and leftmost positions.

On the operation panel 6 are provided a liquid crystal display 6*a* displaying thread information, embroidery patterns and the like which will be described later, a flexible disc drive (hereinafter, "FDD 27"; and see FIG. 6) into which a flexible disc (not shown) is inserted, and the like. More specifically, the liquid crystal display 6*a* displays the embroidery patterns, needle bar numbers corresponding to the respective needle bars 10 (needle bar Nos. 1 to 6 as viewed sequentially from the right in a front view), thread information, names of various functions necessary for a sewing work, various pieces of information related to sewing and the like. A touch panel 6*b* having a plurality of touch keys each comprising a transparent electrode is provided on the front of the liquid crystal display 6*a*. The touch keys are touched by the user so that an embroidery pattern to be sewn, various functions and the like are instructed.

Two illuminators 27*a* and 27*b* are provided at right and left sides between which the needle bar case 10 is moved, respectively, as shown in FIG. 1. The paired illuminators 27*a* and 27*b* will now be described with reference to FIGS. 4 to 5B as well as FIGS. 1 to 3. The illuminator 27*a* has a rectangular box-shaped cover body 29 with an open side and a light transmitting portion 30 covering the open side of the cover body 29 and is mounted on the left side of the needle bar case 5 by a mounting member 31. The mounting member 31 is made of a metal such as stainless steel and has an upper mount 32 mounted on the needle bar case 5, a lower mount 33 on which the cover body 29 and the like are mounted, and a connecting portion 34 connecting between the upper and lower mounts 32 and 33, all of which are formed integrally with the mounting member 32. The mounting member 31 is bent substantially into an L-shape as a whole. More specifically, the upper mount 32 is bent so as to extend along the front and side of the needle bar case 5 and has a front 32*a* formed with a screw hole 32*b*. The upper mount 32 includes a side 32*c* having a rear end provided with a stepped mounting piece 32*e* having a screw hole 32*d* and a stepped guide piece 32*f* which guides the lead wire 35 as will be described later.

The lower mount 33 is formed with a pair of through-holes 33*a* located in front and rear ends thereof and a pair of screw holes 33*b* located right inside the through-holes 33*a*, respectively. Furthermore, the lower mount 33 has an upper rear end in which a notch 33*c* is formed so as to draw the lead wire 35. The mounting member 31 is mounted on a lower end of the left side of the needle bar case 5 by screws 36 and 37 (see FIGS. 2 and 7A) inserted through the screw holes 32*b* and 32*d* of the upper mount 32. In the mounted state of the mounting member 31, the connecting portion 34 is bent so as to be inclined 45 degrees to the left side, for example. As a result, the illuminator 27*a* has an illumination angle α formed between a light axis thereof and a periphery of needle hole P, thereby emitting light obliquely downward in the right direction (see FIG. 7A).

The cover body 29 is formed of a synthetic resin material, for example and has an upper surface (upper side in FIG. 4) formed with a notch 29*a* for the mounting plate, which is cut off so as to continue to the aforesaid open side. A plurality of groove-like heat-dissipating slits 29*b* are formed in the sides of the cover body 29 other than the upper surface. The cover body 29 has two inner corners formed with a pair of bosses 29*d* corresponding to the through-holes 33*a* of the mounting member 31 respectively. A bar-like stopper 29*c* is formed on one of the aforesaid inner corners. Furthermore, each boss 29*d* has a circumferential edge formed with a plurality of radially outwardly protruding small ribs 29*e* located at the proximal end side thereof. The cover body 29 has an inner wall formed with a pair of small protrusions 29*f*. The small ribs 29*e* and the small protrusions 29*f* abut the lower mount 33 of the mounting member 31 such that a gap is defined between the inner wall of the cover body 29 and the lower mount 33.

The light transmitting portion 30 is formed of a transparent acrylic material and generally has a rectangular plate shape. The light transmitting portion 30 has two corners formed with a pair of screw holes 30*a* corresponding to the bosses 29*d* respectively. A generally rectangular sheet attachment portion 30*a* is formed on the inside of the light transmitting portion 30 as shown by broken line in FIG. 4. A light diffusion sheet 39 having a notch 39*a* is attached to the sheet attachment portion 30*a*. The sheet attachment portion 30*b* has a peripheral edge formed with a pair of lock portions 30*c* for retaining the diffusion sheet 39 and a convexity 30*d* which is fitted in the notch 30*a* to prevent wrong assembly of the diffusion sheet 39 (inside-out attachment, different type or the like). The diffusion sheet 39 may be formed integrally with the light transmitting portion 30. The bosses 29*d* of the cover body 29 are fitted in the through holes 33*a* of the mounting member 31 respectively. In this state, two screws 38 are inserted through the screw holes 30*a* of the light transmitting portion 31 are threadingly engaged with the bosses 29*d* respectively, whereby the cover body 29 and the light transmitting portion 30 are attached to the mounting member 31.

A heat dissipating plate 40 and a substrate 41 are housed in the illuminator 27*a* so as to be placed on the lower mount 33 of the mounting member 31 in turn. The heat dissipating plate 40 is made of a metal such as aluminum and has a peripheral edge that is folded except for the rear so as to surround the substrate 41 thereby to serve as a folded portion 40*a*. The heat dissipating plate 40 has two through-holes 40*b* corresponding to the screw holes 33*b* of the lower mount 33 respectively and is disposed so as to come close to the lower mount 33.

Figure 5A:
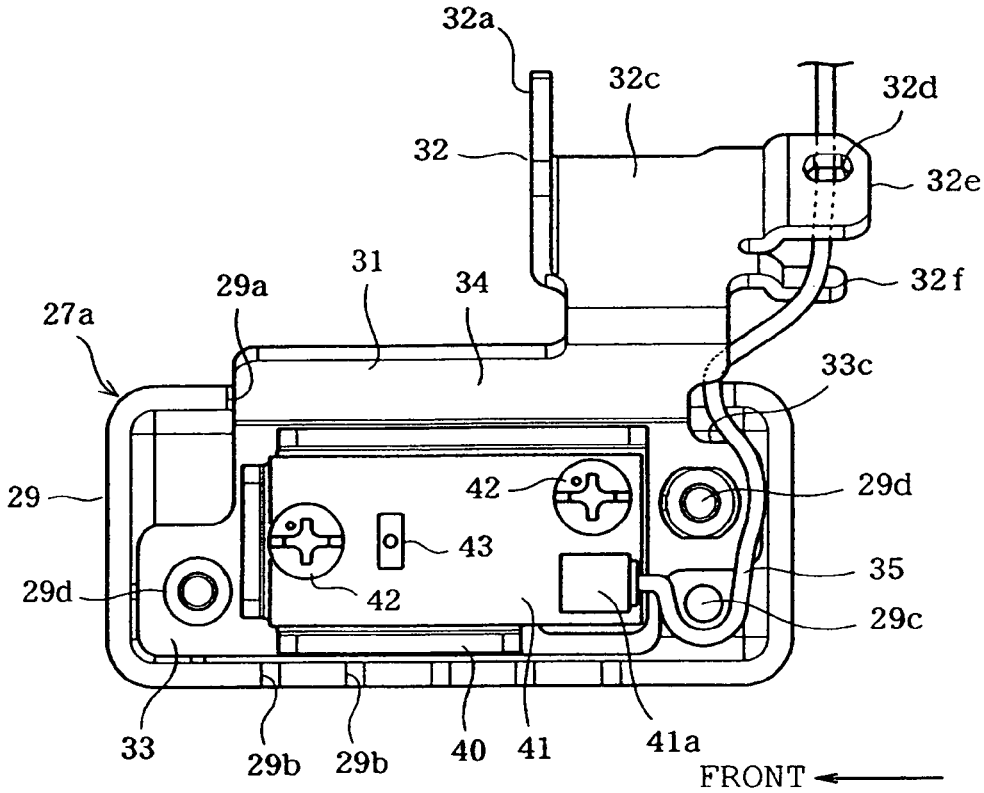
FIGS. 5A and 5B are side views of left and right illuminators with light transmitting parts being detached respectively.

A pair of screws 42 inserted through opposite ends of the substrate 41 and the through holes 40*b* of the heat dissipating plate 40 are threadingly engaged with the screw holes 33*b* of the lower mount 33, whereby the substrate 41 is fixed via the heat dissipating plate 40 to the lower mount 33. A chip LED 43 serving as a light source is mounted on the substrate 41. The chip LED 43 will hereinafter be referred to as "LED 43." A connector 41*a* is provided at a position where the connector 41*a* faces the stopper 29*a* of the cover body 29. As shown in FIG. 5A, the lead wire 35 for energization of LED 43 bypasses the lower portion of the stopper 29*c* from the connector 41*a* and extends through the notch 33*c* in the rear of the mounting member 31, the guide piece 32*f*, and the front and upper surface of the needle bar case 5, being connected to the control device 8 at the sewing machine body 7 side. Since the lead wire 5 is wired so as to bypass the periphery of the stopper 29*c*, the lead wire 5 is adapted to be prevented from being disconnected from the connector 41*a*.

Figure 5B:
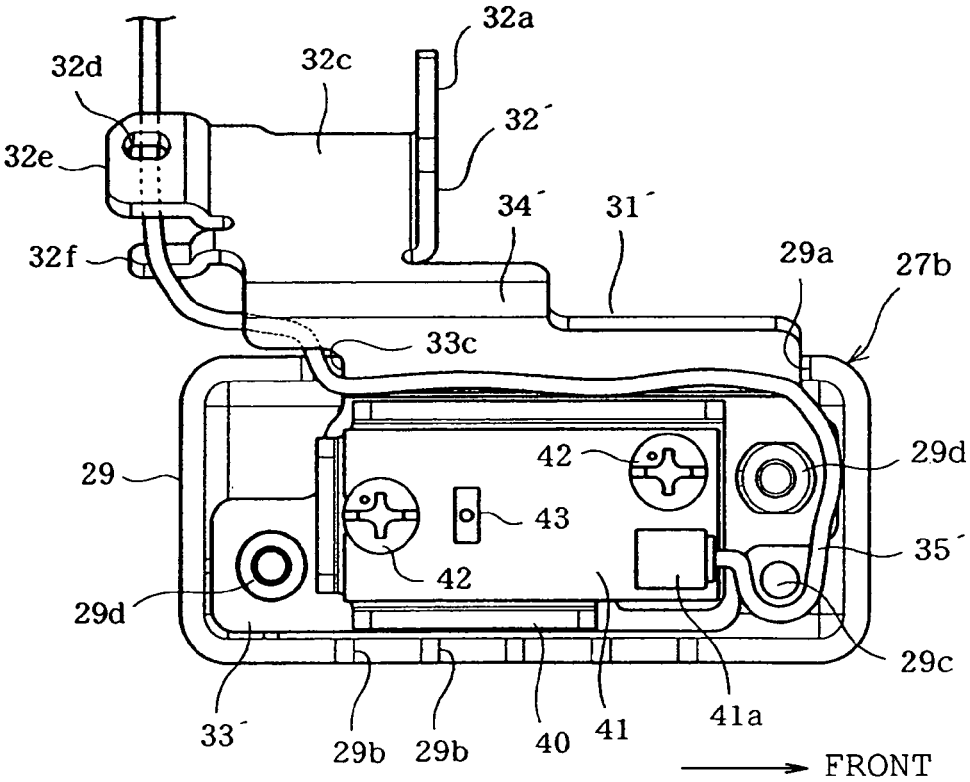

The right illuminator 27*b* comprises the same components as of the above-described left illuminator 27*a*. More specifically, the illuminator 27*b* has a cover body 29 and a light transmitting portion 30 and is mounted on the needle bar case 5 by amounting member 31' as shown in FIGS. 1 and 5B. The mounting member 31' includes an upper mount 32', a lower mount 33' and a connecting portion 34' all of which are substantially symmetrical with the mounting member 31 with respect to a center line L1 (see FIG. 7A) dividing the needle bar case 5 and serving as a symmetrical axis. Accordingly, the connecting portion 34' is folded so that the lower mount 33' is inclined, for example, 45 degrees rightward relative to the upper mount 32' with the upper mount 32' being mounted on the lower end of the right side of the needle bar case 5. As a result, an illumination angle α (see FIG. 7A) in the right-left direction relative to the periphery of the needle hole P is set to, for example, 45 degrees, whereupon the illuminator 27*b* emits light obliquely downward in the left direction. Furthermore, as shown in FIG. 5B, a lead wire 35' of the illuminator 27*b* bypasses the lower portion of the stopper 29*c* from the connector 41*a* and extends through the notch 33*c* in the rear of the mounting member 31, the guide piece 32*f*, and the front and upper surface of the needle bar case 5, being connected to the control device 8 at the sewing machine body 7 side.

Thus, the illuminators 27*a* and 27*b* are mounted on the needle bar case 5 so as to open the peripheries of the needle bars 10 and the needles 10*a*. Accordingly, the illuminators 27*a* and 27*b* can be prevented from hindering the hooking of needle thread and the exchange of needles 10*a* and can sufficiently illuminate the surface of the workpiece cloth.

Figure 6:
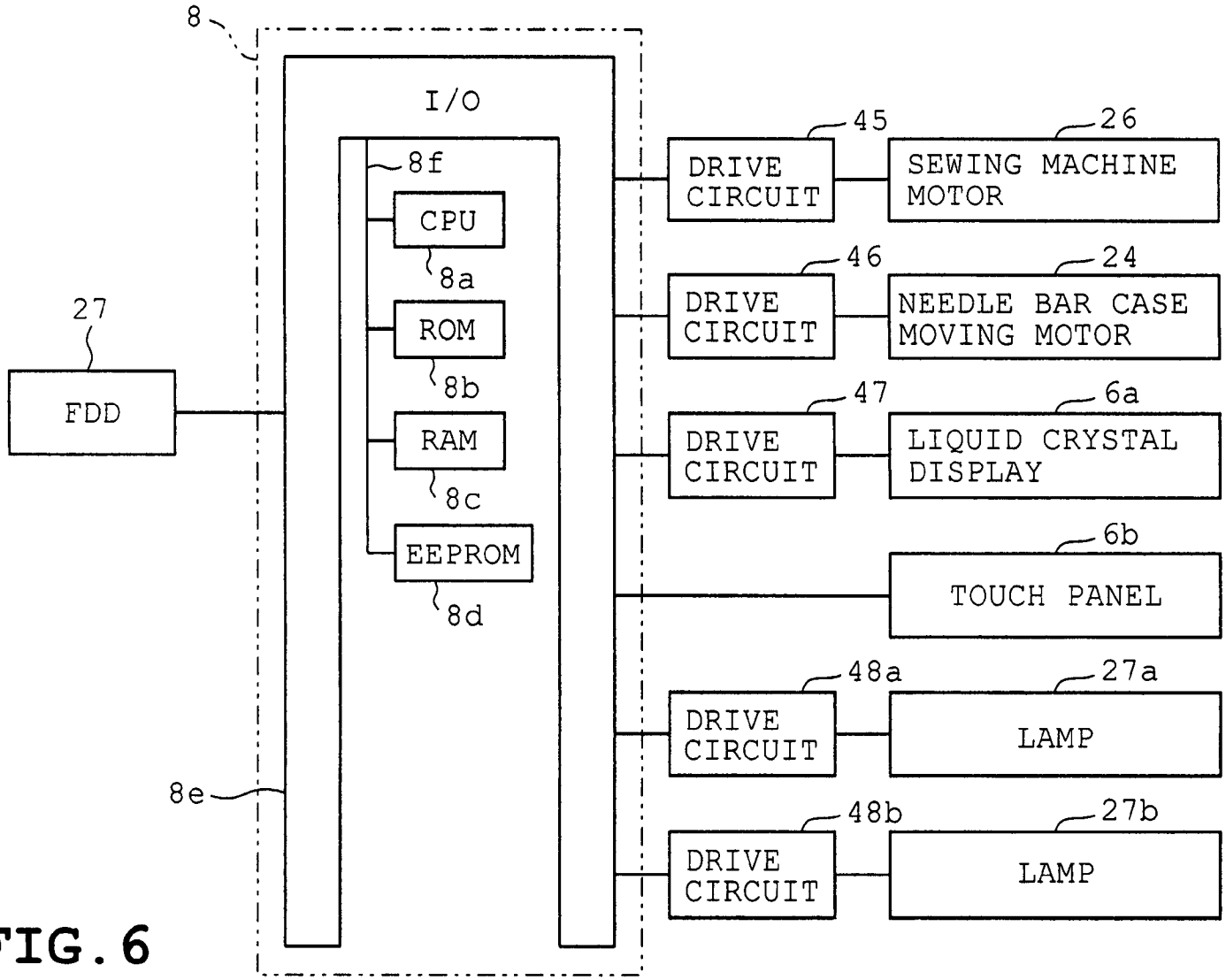
FIG. 6 is a block diagram showing an electrical arrangement of the multineedle sewing machine.

The arrangement of the control system of the multineedle sewing machine M will now be described with reference to the block diagram of FIG. 6. The control device 8 is mainly configured by a microcomputer and incorporates a CPU 8*a*, a ROM 8*b*, a RAM 8*c*, an EEPROM 8*d*, an input/output interface (I/O) 8*e*, a bus 8*f* connecting these devices to one another, and the like. The FDD 27 and the touch panel 6*b* are connected to the I/O 8*e*. To the I/O 8*e* are also connected drive circuits 45, 46, 47, 48*a* and 48*b* driving the sewing machine motor 26, needle bar case moving motor 24, liquid crystal display 6*a*, illuminators 27*a* and 27*b* respectively. The drive circuits 48*a* and 48*b* are configured so as to adjust the illuminances of LEDs 43 as light adjusting circuits (light adjusting units) that adjust amounts of light emitted from the LEDs 43 of the illuminators 27*a* and 27*b* independently, respectively.

The ROM 8*b* stores embroidery data of various embroidery patterns, a sewing control program, an all thread information table that is a list of all thread information relating to a plurality of types of threads used in the sewing, a thread designation control program for interrelating thread information of the needle thread supplied from the thread spool and the needle bar 10 by the user, and the like. Furthermore, the ROM 8*b* stores a table of electric current values of the illuminators 27*a* and 27*b* that are set so as to correspond to the needle bar numbers (needle bar Nos. 1 to 6 assigned to the needle bars 10 sequentially from the right needle bar in front view). The aforesaid embroidery data includes embroidery thread information (information about thread colors of embroidery patterns including blue, yellow-green, purple and the like, for example) and needle drop position data together with an embroidering sequence in which embroidering is carried out with use of a thread. The embroidery data, the current value table and the like may be stored on an external storage device such as a flexible disc so that the data is retrieved from the FDD 27 or the like.

The RAM 8*c* is provided with a memory for storing needle bar and thread information about a thread color set in association with the needle bar Nos. 1 to 6 and various memories for storing results of computation executed by the CPU 8*a*, pointers, counters and the like as the need arises. The needle bar and thread information may be stored on the RAM 8*c* by inputting the needle bar No. or by the detection of a thread information sensor provided on the thread spool for detecting needle bar and thread information. Furthermore, thread exchange may be carried out before start of sewing so that the needle bar and thread information and the embroidery thread information (thread colors of embroidery pattern) correspond with each other. As a result, sewing can be executed without interrupt.

The control device 8 controls the motors 24 and 26 and various actuators according to the sewing control program, embroidery data and the like so that a sequence of sewing operation is executed on the workpiece cloth. In the sewing, the control device 8 compares the embroidery thread information and the embroidery sequence of the embroidery data with the needle bar and thread information, so that the needle bar 10 to which the needle thread corresponding to the embroidery thread information is selectively switched as the needle bar 10 to be used for sewing. Furthermore, the control device 8 reads a current value according to the selected needle bar 10 from the current value table, thereby controlling the drive circuits 48*a* and 48*b*. The control device 8 and the drive circuits 48*a* and 48*b* constitute the illumination device together with the illuminators 27*a* and 27*b* and mounting members 31 and 31'.

Figure 7A:
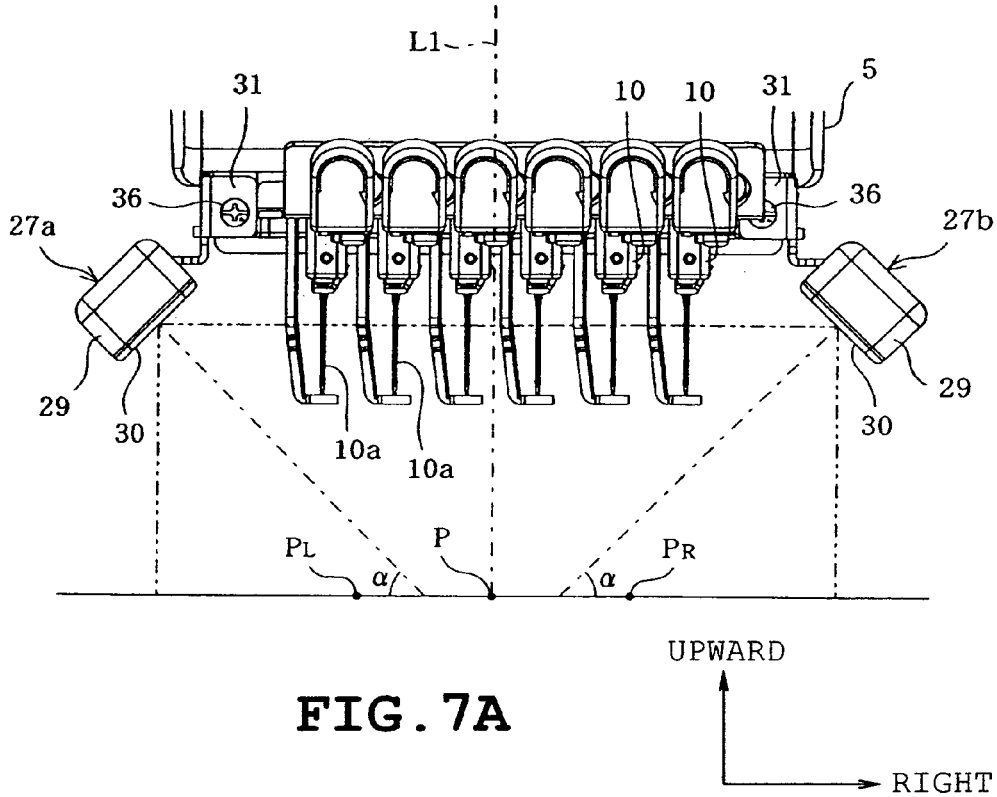
FIGS. 7A and 7B are enlarged front views of a part of the multineedle sewing machine near the needle drop position with the needle bar case having been moved to a neutral position and with the needle bar having been switched to needle bar number 2 respectively.

Illuminance characteristics of the illuminators 27*a* and 27*b* and a current value table will be described with reference to FIGS. 7A to 8. FIG. 7A shows the needle bar case 5 which has been moved by the needle bar case moving mechanism 25 thereby to be located at an intermediate position between the foregoing rightmost and leftmost positions. In this state, both illuminators 27*a* and 27*b* are in such a positional relation that the aforesaid central line L1 becomes a symmetrical axis in a front view. Furthermore, since light emitted from the LED 43 of each of the illuminators 27*a* and 27*b* is diffused by the diffusion sheet 39, the light directionality is attenuated, and an area illuminated by each of the illuminators 27*a* and 27*b* is rendered relatively wider as shown by two-dot chain line in FIG. 7A.

Figure 7B:
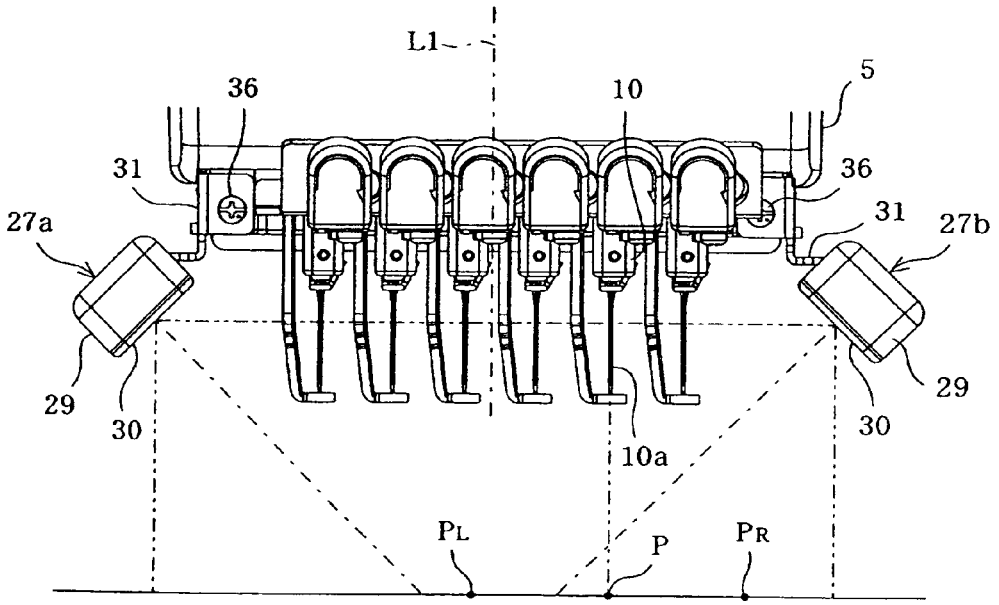

In the above-described state, the predetermined illuminance (300 Lx or above, for example) is ensured near the needle hole P by the illuminators 27*a* and 27*b*. On the other hand, FIG. 7B shows the state where the needle bar case 5 has been moved leftward together with the illuminators 27*a* and 27*b* by the needle bar moving mechanism 25 such that the needle bar 10 of No. 2 (hereinafter, "needle bar No. 2") has been switched to the needle drop position or switched so as to correspond to the needle drop position. In this case, there is a possibility that a suitable illuminance may not be ensured near the needle hole P since the relative positional relation between the needle hole P and the illuminators 27*a* and 27*b* becomes imbalanced.

The inventors conducted an experiment to measure current values of the illuminators 27*a* and 27*b* (LEDs 43) necessary to maintain the illuminance of 300 Lx or above near the needle hole P when any one of needle bar Nos. 1 to 6 is switched to the needle drop position. In the experiment, illuminance was measured at three positions as the illuminance near the needle hole P, that is, at the position of the needle hole P, the position $P_L$ spaced leftward 30 mm from the needle hole P and the position $P_R$ spaced rightward 30 mm from the needle hole P. The current values of the illuminators 27*a* and

27*b* were increased or decreased so that the illuminance at each measurement position exceeded the value of 300 Lx.

Figure 8:
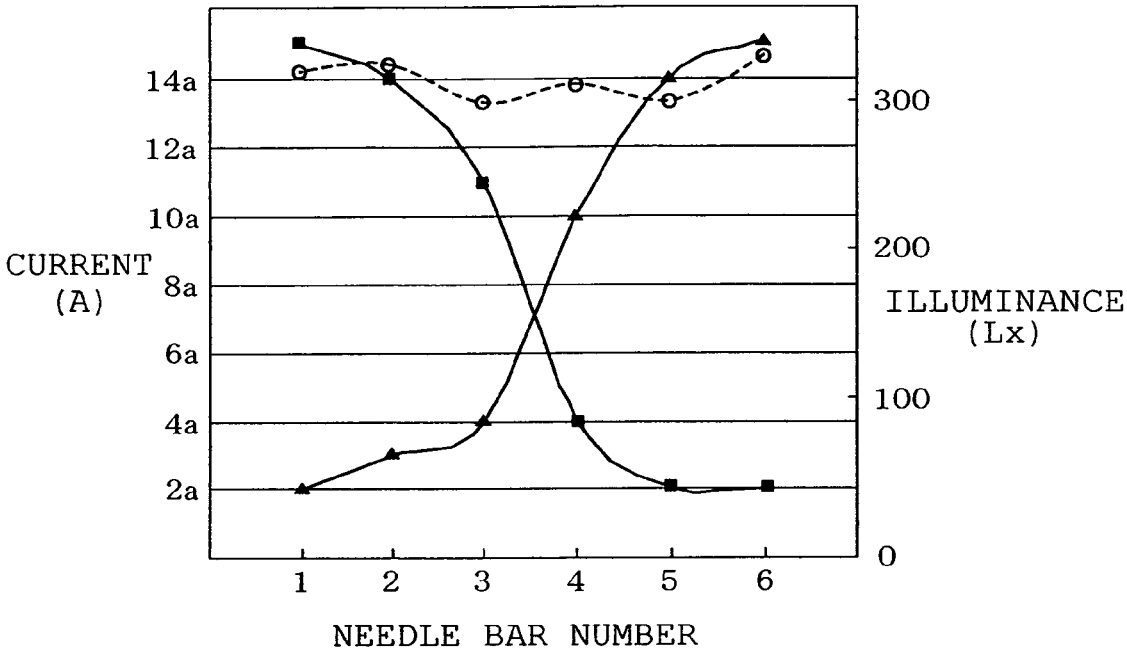
FIG. 8 is a graph showing the relationship between electric current values of the illuminators and an illuminance near the eye of a needle when needle bar number 1 to 6 are switched.
Figure 9:
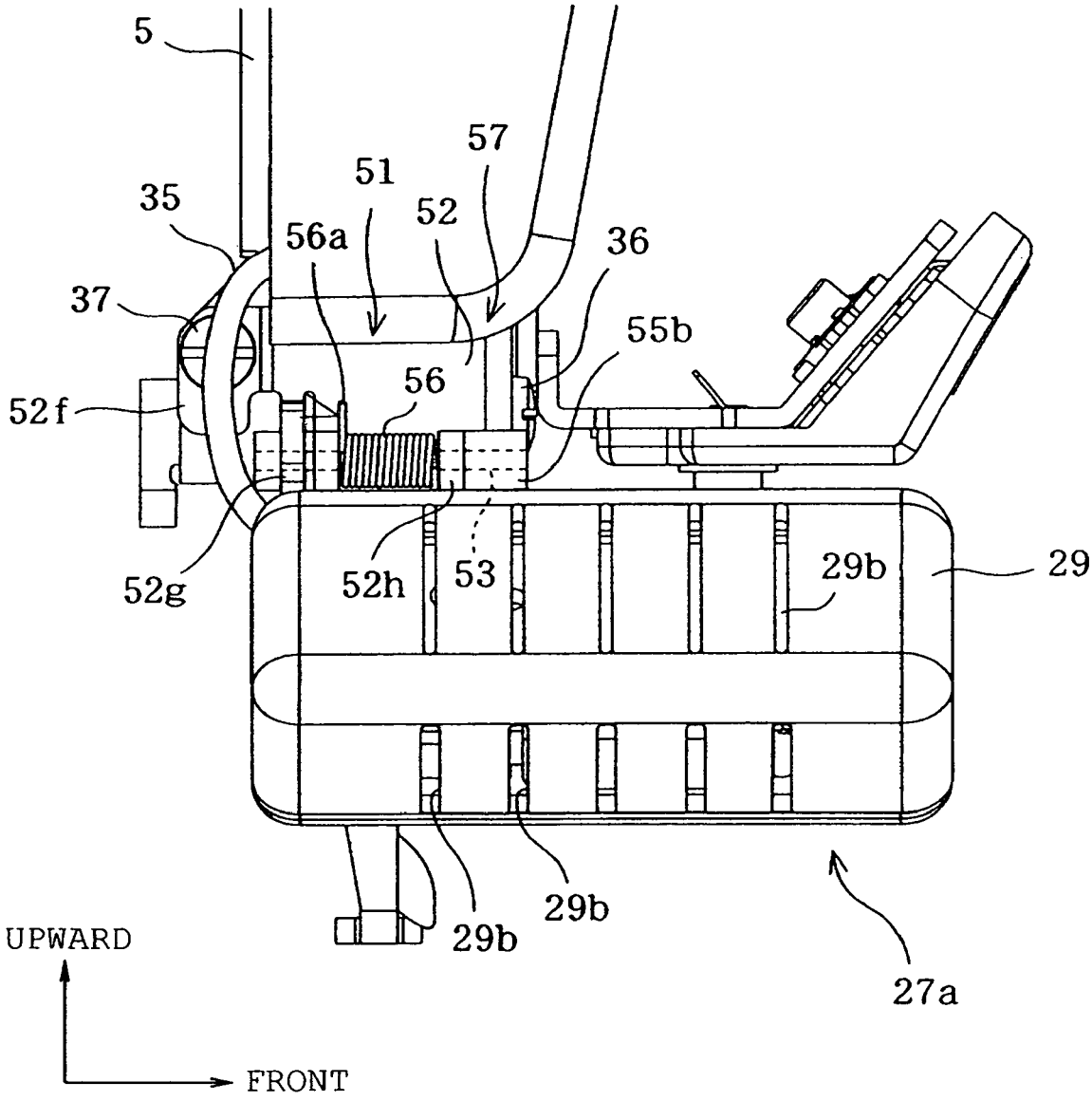
FIG. 9 is an enlarged left side view of the left illuminator and a periphery thereof in the illumination device of a second embodiment.

FIG. 8 shows the relationship between the current values in ampere A of the illuminators 27*a* and 27*b* and the illuminance near the needle hole P when each of needle bar Nos. 1 to 6 were switched to the needle drop position. As obvious from the figure, in order that the illuminance of 300 Lx or above may be ensured near the needle hole P, the current of the left illuminator 27*a* needs to be set at a highest value when needle bar No. 1 is switched to the needle drop position, and the set value is rendered lower as needle bar Nos. 2 to 6 are sequentially switched. On the other hand, the current of the right illuminator 27*b* needs to be set at a lowest value when the needle bar No. 1 is switched to the needle drop position, and the set value is rendered higher as needle bar Nos. 2 to 6 are sequentially switched. The current values of the illuminators 27*a* and 27*b* are equalized to each other at the intermediate position of the needle bar case 5. Based on the experimental results, the current value table is set so that the current value of the illuminator 27*a* is gradually decreased and the current value of the illuminator 27*b* is gradually increased according to needle bar Nos. 1 to 6.

The illumination device thus constructed will work as follows. In execution of sewing, the user operates the touch panel 6*b* to set a desired embroidery pattern and further edit a color of each part of the embroidery pattern and the size of the embroidery pattern, if desired. Upon start of sewing, the control device 8 controls the motors 24 and 26 and various actuators according to the sewing control program based on the embroidery data of the embroidery pattern set by the user, so that a sequence of sewing operation is executed on the workpiece cloth.

The area near the needle hole P is illuminated at a predetermined illuminance by the illuminators 27*a* and 27*b* located at opposite sides of the needle bar case 5 during the sewing. Furthermore, when the needle bar 10 is switched, the control device 8 carries out the following control manner so that the predetermined illuminance is maintained at least near the needle hole P. More specifically, when the thread color is changed, the control device 8 compares embroidery thread information of the embroidery data and the embroidering sequence with the needle bar thread information to determine, as the needle bar 10 to be used for sewing, the needle bar 10 (needle bar No. 2, for example) to which the needle thread corresponding to the embroidery thread information has been supplied. In this case, the control device 8 drives the needle bar case moving motor 24 to move the needle bar case 5 by the needle bar case moving mechanism 25, thereby selectively switching needle bar No. 2 into the needle drop position (see FIG. 7B).

In the above-described case, the control device 8 reads the corresponding current value from the current value table according to the switched needle bar No. 2 thereby to control the drive circuits 48*a* and 58*b*. As a result, an amount of light emitted from the left illuminator 27*a* is adjusted so as to be rendered relatively larger, and an amount of light emitted from the right illuminator 27*b* is adjusted so as to be rendered relatively smaller (see FIGS. 7B and 8), whereupon the illuminance of 300 Lx or above is maintained near the needle hole P. Thus, even when any one of needle bar Nos. 1 to 6 is switched into the needle drop position during sewing, the control device 8 controls the drive circuits 48*a* and 48*b* individually according to the position of the needle bar case 5 after the switching of the needle bar 10 (namely, the relative positional relation between the illuminators 27*a* and 27*b* and the needle hole P). Consequently, for example, the illuminance of 300 Lx or above can be obtained near the needle hole P.

According to the above-described embodiment, the illumination device includes the drive circuits 48*a* and 48*b* serving as the light adjusting units which adjust amounts of light emitted from the LEDs 43 of the illuminators 27*a* and 27*b*, respectively and the control device 8 which controls the drive circuits 48*a* and 48*b* with movement of the needle bar case 5 together with the illuminators 27*a* and 27*b* by the needle bar case moving mechanism 25 so that the predetermined illuminance is maintained at least near the needle hole P in the illumination area. According to this construction and arrangement, the predetermined illuminance can be ensured near the needle drop position even when any one of needle bar Nos. 1 to 6 is selected. Accordingly, the conventional problem of the decrease in the illuminance with movement of the needle bar case can be overcome. Furthermore, since the illuminators 27*a* and 27*b* are disposed at the lateral sides of the needle bar case 5, the hooking of the needle thread and replacement of the needles 10*a* can be carried out while the area at the side of the peripheries of the needle bars 10 and the needles 10*a* or at the side of the front of the needle bar case 5 is fully open. Consequently, the hooking of the needle thread and the exchange or replacement of the needles 10 can smoothly be carried out without being hindered by the illuminators 27*a* and 27*b*.

The needle bar case 5 is reciprocally moved, and the illuminators 27*a* and 27*b* are disposed along the movement direction of the needle bar case 5. According to this construction, one of the illuminators 27*a* and 27*b* can illuminate so that shadows of components resulting from illumination by the other illuminator is prevented from being made in the illuminated area. Furthermore, since two illuminators 27*a* and 27*b* are provided, the illuminated area can be enlarged and a sufficient illuminance can be obtained as compared with the case where a single illuminator is provided for illumination. Moreover, the drive circuits 48*a* and 48*b* are individually controlled by the control device 8 so that an amount of light emitted from one of the illuminators 27*a* and 27*b* is decreased, while a predetermined illuminance is ensured. This can reduce electric power consumption. Accordingly, the illumination device is advantageous in the energy saving and beneficial from a practical standpoint.

FIGS. 9 to 11B illustrate a second embodiment. Identical or similar parts in the second embodiment are labeled by the same reference symbols as those in the first embodiment, and only the difference between the first and second embodiments will be described. The description of the right illuminator 27*b* will be eliminated since the right illuminator 27*b* has the same structure as the left illuminator 27*a* and is disposed so as to be substantially bilaterally symmetrical to the left illuminator 27*a* about the aforesaid center line L1.

Figure 10:
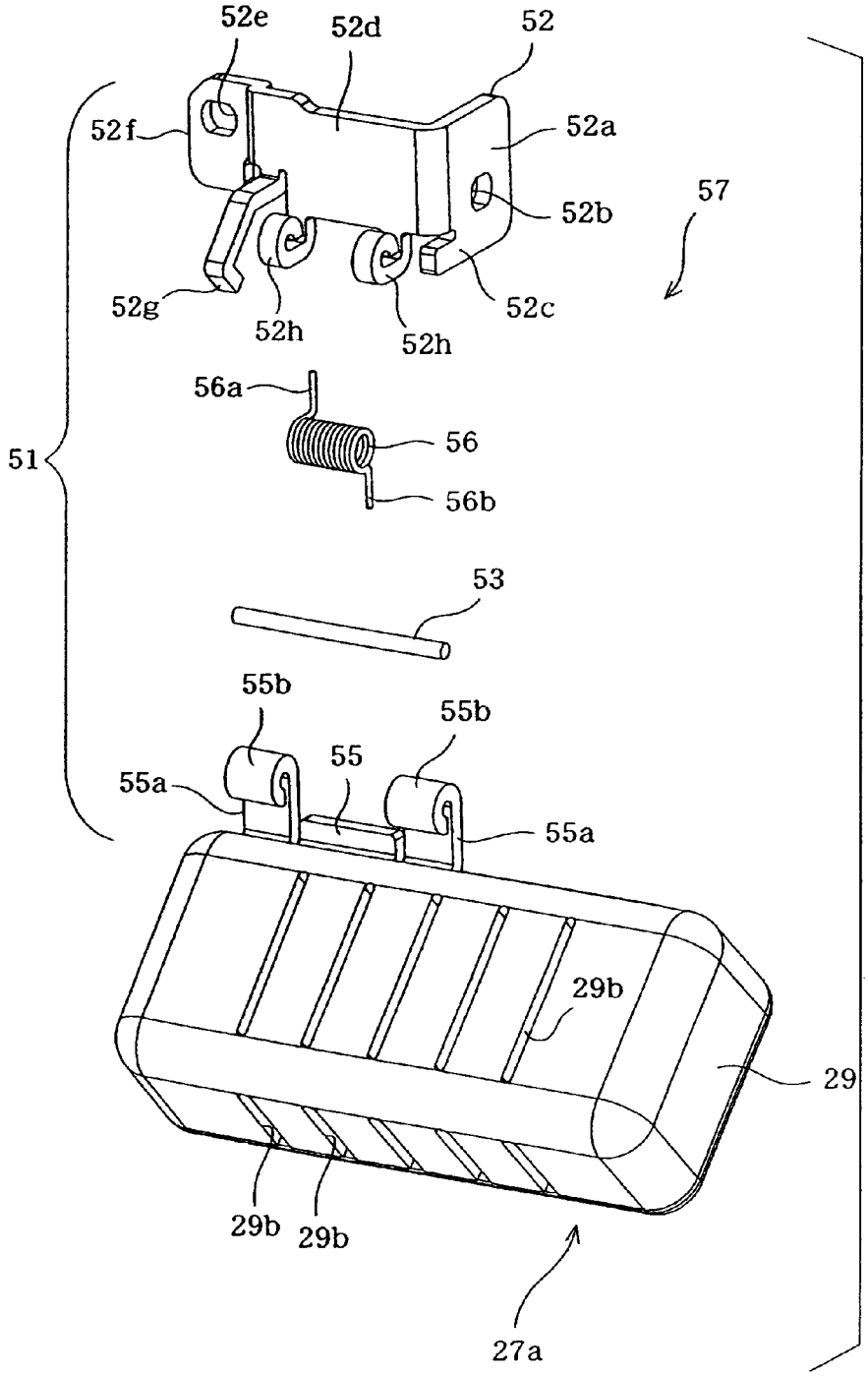
FIG. 10 is an exploded perspective view of a first supporting mechanism and the illuminator.

The mounting members in the second embodiment differ from the mounting members 31 and 31' in the following respects. A first support mechanism 51 serving as the mounting member includes an upper mount 52, the lower mount 33 and a support bar 53 which supports the lower mount 33 so that the lower mount 33 is swingable relative to the upper mount 52. In more detail, the lower mount 33 has an upper end having an integrally formed connecting portion 55 which is provided instead of the upper mount 32 and the connecting portion 34 in the first embodiment, as shown in FIG. 10. The connecting portion 55 has a pair of upwardly directed strips 55*a* formed on front and rear ends thereof. Each strip 55*a* has a distal end formed with a generally C-shaped insertion portion 55*b*.

The upper mount 52 is bent so as to extend along the side surface and front and has a front 52*a* formed with a screw hole 52*b*. A protrusion-like first limit portion 52*c* is provided on a lower end of the front 52*a* of the upper mount 52 so as to abut the strips 55*a*. The upper mount 52 further includes a side 52*d* having a rear end provided with a stepped mount piece 52*f* having a screw hole 52*e*. A hook-like second limit portion 52*g* is provided on a rear part of the side 52*d* of the upper mount 52 so as to abut the strips 55*a*. The second limit portion 52*g* is located right in front of the mount piece 52*f* and juts leftward. The side 52*d* of the upper mount 52 has a lower end formed with a pair of generally C-shaped insertion portions 52*h*. The upper mount 52 is mounted on a lower end of the left side of the needle bar case 5 by two screws 36 and 37 (see FIG. 9) inserted through the screw holes 52*b* and 52*e* respectively.

Figure 11A:
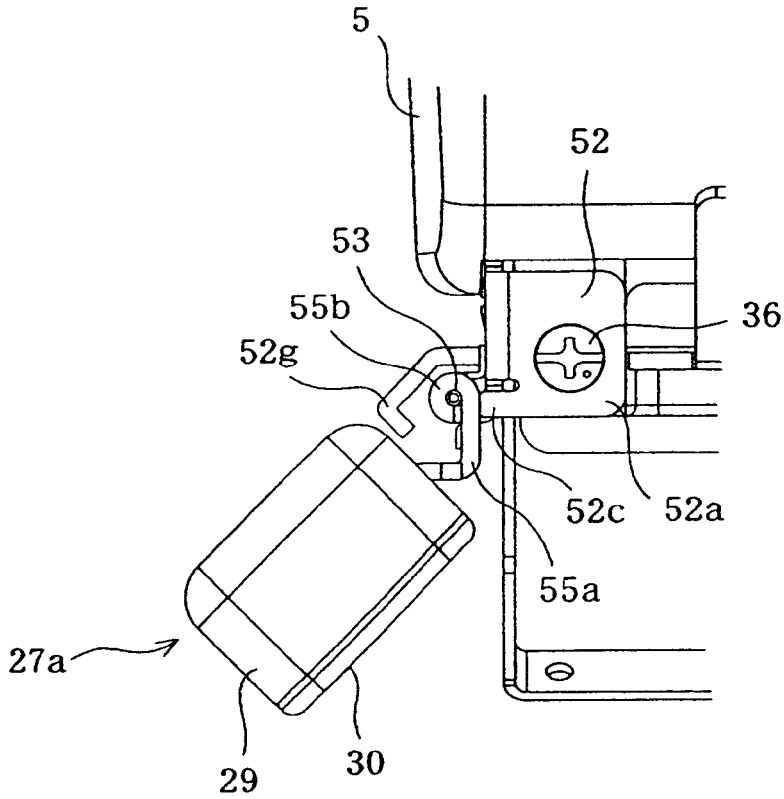
FIGS. 11A and 11B are enlarged front views of the illuminator and the periphery thereof when the illuminator is located at the illumination position and the retreat position respectively.
Figure 11B:
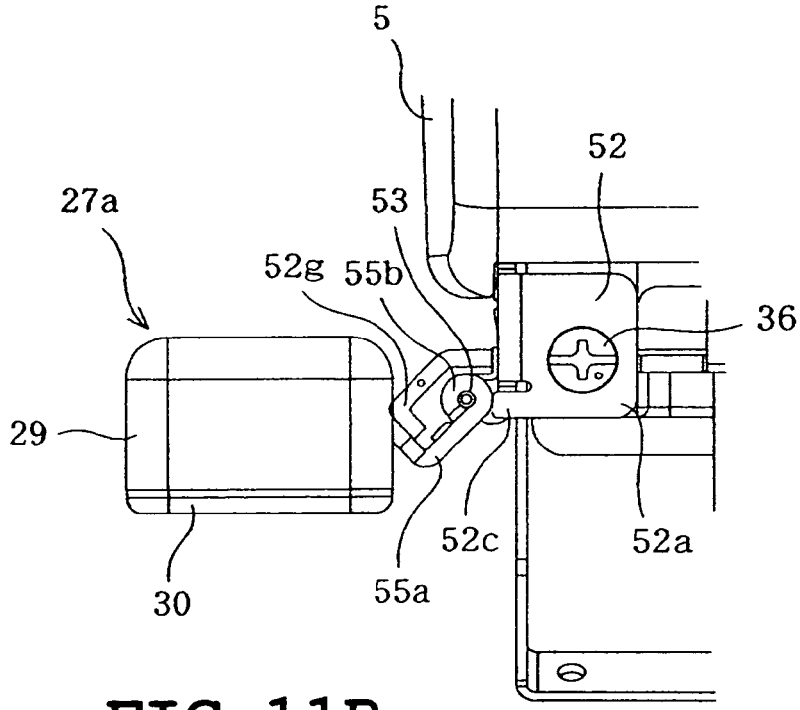

The support bar 53 is loosely inserted through the insertion portions 52*h* and press fitted through the insertion portions 55*b* while the insertion portions 52*h* and 55*b* are aligned. The lower mount 33 (the illuminator 27*a*) is supported on the support bar 53 so as to be swingable relative to the needle bar case 5. The swinging movement of the illuminator 27*a* is limited to a range between an illuminating position as shown in FIG. 11A and a retreat position as shown in FIG. 11B since the strips 55*a* of the connecting portion 55 abut the first or second limit portion 52*c* or 52*g*.

A torsion coil spring 56 serving as an urging member is provided around the support bar 53 so as to be located between the paired insertion portions 52*h*. The torsion coil spring 56 has two ends 56*a* and 56*b*, and the end 56*a* thereof is engaged with the side 52*d* of the upper mount 52 thereby to be locked. The other end 56*b* of the torsion coil spring 56 is engaged with the connecting portion 55 thereby to be locked. As a result, the torsion coil spring 56 urges the illuminator 27*a* so that the illuminator 27*a* is maintained at the illuminating position. In this case, the illuminator 27*a* abuts the first limit portion 52*c* when located at the illuminating position and accordingly, the aforesaid illumination angle is set at 45 degrees.

The upper mount 52, lower mount 33, connecting portion 55 and support bar 53 serve as a support member 57 which supports the illuminator 27*a* so that the illuminator 27*a* is swingable between the illuminating position and the retreat position. Furthermore, the support member 57 and the torsion coil spring 56 constitute the first support mechanism 51. The description of the right first support mechanism 51' will be eliminated since the first support mechanism 51' has the same structure as the left first support mechanism 51 and is disposed so as to be substantially bilaterally symmetrical to the left first support mechanism 51 about the center line L1 as in the first embodiment.

According to the second embodiment, the illuminators 27*a* and 27*b* can be swung by the first support mechanisms 51 and 51' between the illuminating position where the illumination area is illuminated by the LEDs 43 and the retreat position differing from the illuminating position. Accordingly, as shown in FIG. 11B, when the illuminators 27*a* and 27*b* are subjected to an external force during the thread hooking, the illuminators 27*a* and 27*b* can be escaped to the retreat position so as not to hinder the thread hooking. Consequently, the user need not return the illuminators 27*a* and 27*b* to the illuminating position.

FIGS. 12 to 15 illustrate a third embodiment. Identical or similar parts in the third embodiment are labeled by the same reference symbols as those in the first embodiment, and only the difference between the first and third embodiments will be described. The description of the right illuminator 61*b* will be eliminated since the right illuminator 61*b* has the same structure as the left illuminator 61*a* and is disposed so as to be substantially bilaterally symmetrical to the left illuminator 61*a* about the aforesaid center line L1.

Firstly, the cover body 29 and the light transmitting portion 30 both constituting an outer shell of the illuminator 61*a* have slightly larger dimensions than those of the illuminator 27*a* in the first embodiment respectively. Since the construction of the illuminator 61*a* is substantially the same as that in the first embodiment in the other respects, the description thereof will be eliminated.

Figure 12:
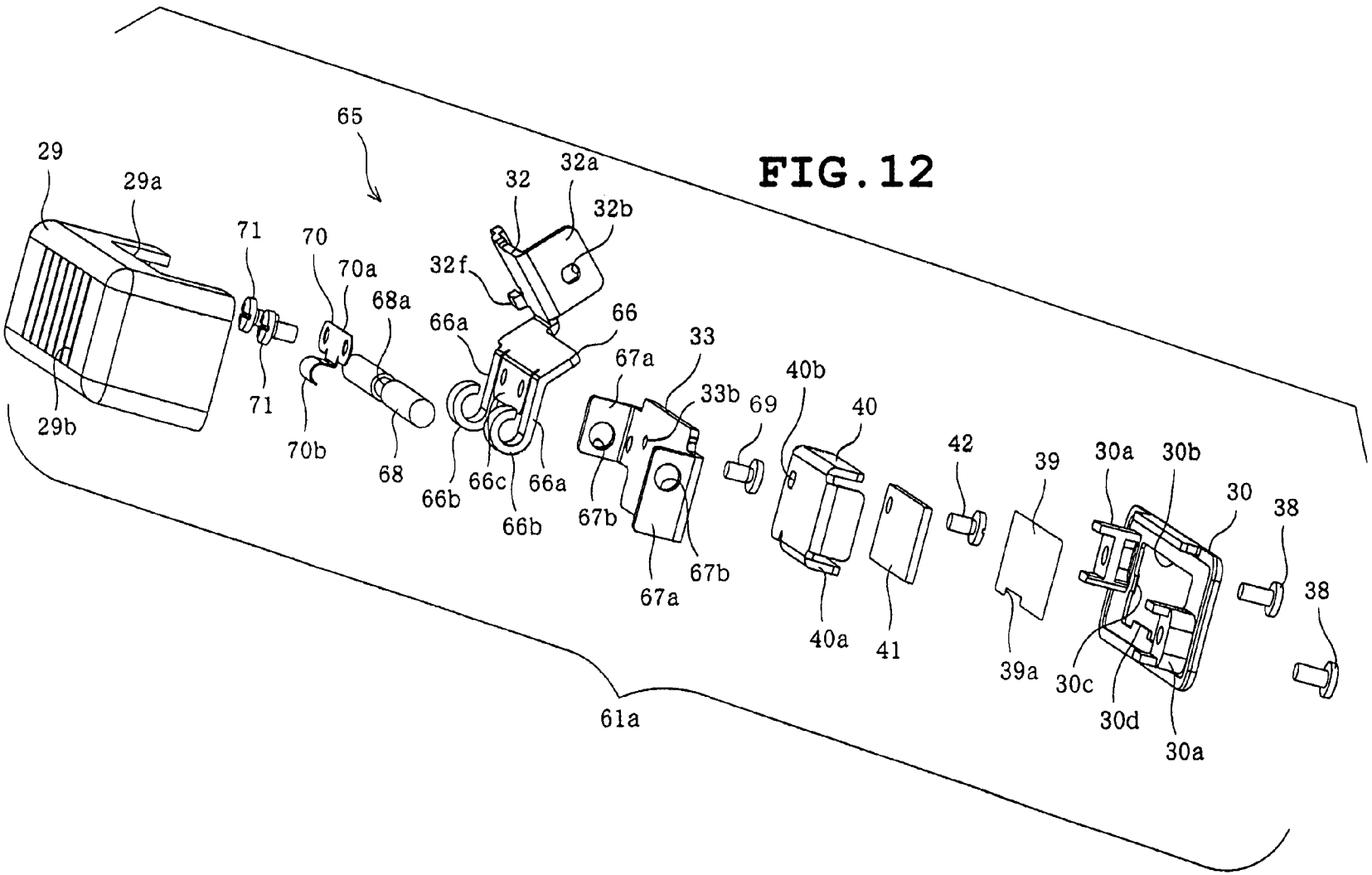
FIG. 12 is an exploded perspective view of the illuminator and a second supporting mechanism of the illumination device of a third embodiment.

As obvious from the comparison between FIGS. 12-13B and FIG. 4, the mounting member in the third embodiment differs from the mounting members 31 and 31' in the first embodiment in the following respects. The second support mechanism 65 serving as the mounting member includes the upper mount 32, the lower mount 33 and a connecting member 66 formed integrally with the upper mount 32. In more detail, as shown in FIG. 12, the lower mount 33 is discrete from the upper mount 33 and the connecting portion 66. The lower mount 33 has front and rear ends both of which are folded rightward into folded portions 67*a* formed with respective through-holes 67*b*.

On the other hand, the connecting member 66 has a pair of downwardly directed strips 66*a* formed on front and rear ends thereof. The strips 66*a* have respective C-shaped insertion portions 66*b*. The connecting member 66 further has a spring mount 66*c* located between the strips 66*a*. The support bar 68 is inserted through the through-holes 67*b* of the lower mount 33 and the insertion portions 66*b* of the connecting member 66. As a result, the lower mount 33 (the illuminator 61*a*) is supported so as to be swingable relative to the needle bar case 5.

Figure 14A:
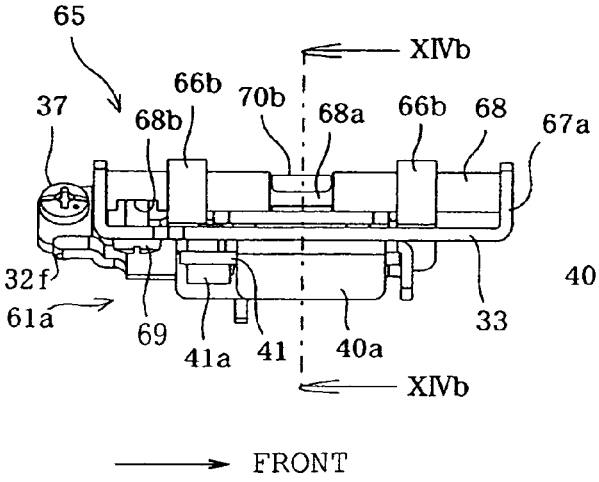
FIGS. 14A and 14B show the illuminator and the second supporting mechanism as viewed in the direction of arrow A in FIG. 13A and taken along line XIVb-XIVb in FIG. 14A respectively.
Figure 14B:
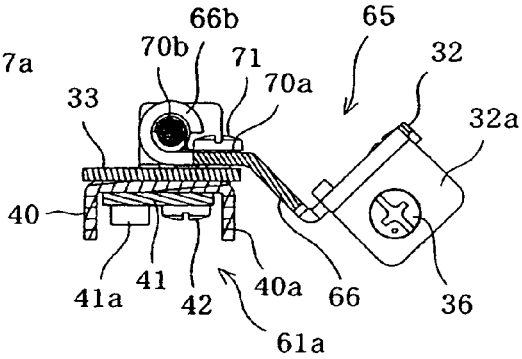

The support bar 68 is formed into a generally columnar shape and has a reduced-diameter portion 68*a* formed in the axial middle thereof. Furthermore, as shown in FIG. 14A, the support bar 68 has a rear end having a flat portion 68*b* formed by cutting out a part of the outer circumference thereof. A screw 69 threadingly engaged with the rear end of the lower mount 33 abuts the rear end of the lower mount 33 so that the support bar 68 is fixed so as not to be turned relative to the lower mount 33.

Figure 13A:
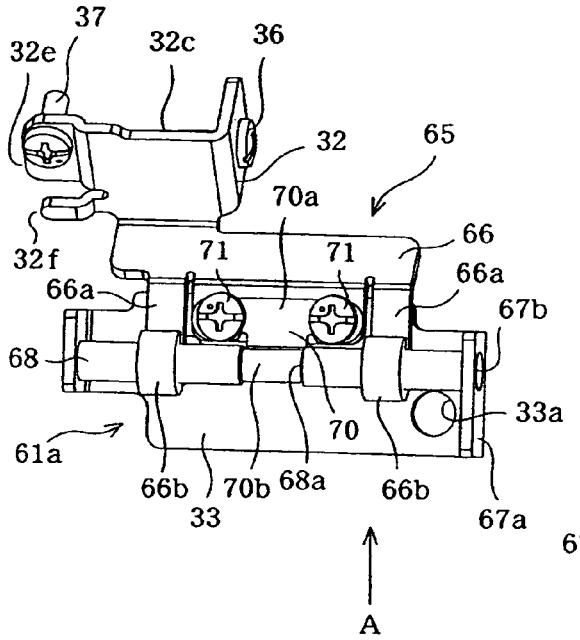
FIGS. 13A and 13B are perspective views of the illuminator and the second supporting mechanism with the cover body and the light transmitting part being detached as viewed at the left and right sides respectively.
Figure 13B:
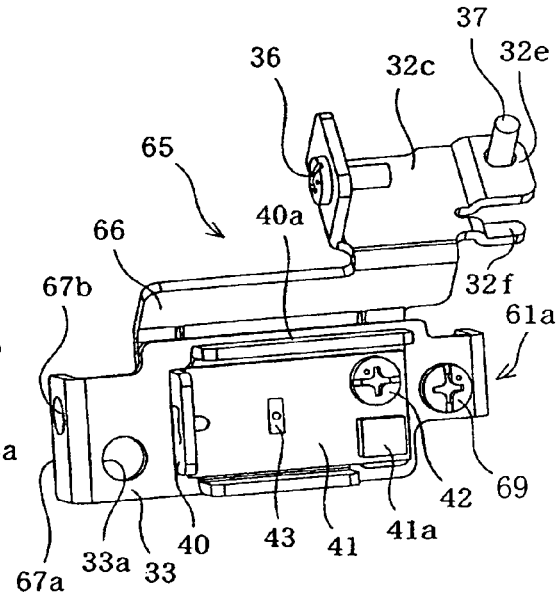

A leaf spring 70 is mounted on the spring mount 66*c* of the connecting member 66 to support the illuminator 61*a* so that illuminator 61*a* is maintained at a position during the swinging movement, as shown in FIG. 13A. The leaf spring 70 has a plate-like fixing portion 70*a* and a semicylindrical spring piece 70*b* formed on a side of the fixing portion 70*a*. Both of the fixing portion 70*a* and the spring piece 70*b* are formed integrally with the leaf spring 70. The fixing portion 70*a* is mounted on the spring mount 66*c* by two screws 71. When the spring piece 70*b* is elastically pressed against the circumference of the reduced-diameter portion 68*a*, the illuminator 61*a* is held by the leaf spring 70 so as to be transferable to any swinging position. Furthermore, when the spring piece 70*b* is fitted with the reduced-diameter portion 68*a*, the support bar 68 is locked by the spring piece 70*b* so as to be axially immovable. Thus, the second support mechanism 65 supporting the illuminator 61*a* so that the illuminator 61*a* is transferable to any swinging position is constituted by the upper mount 32, the lower mount 33, the connecting member 66, the support bar 68, the leaf spring 70 and the like. The description of the other second support mechanism 65' will be eliminated since the second support mechanism 65' has the same structure as the second support mechanism 65 and is disposed so as to be substantially bilaterally symmetrical to the second support mechanism 65 about the center line L1 as in the first embodiment.

Figure 15:
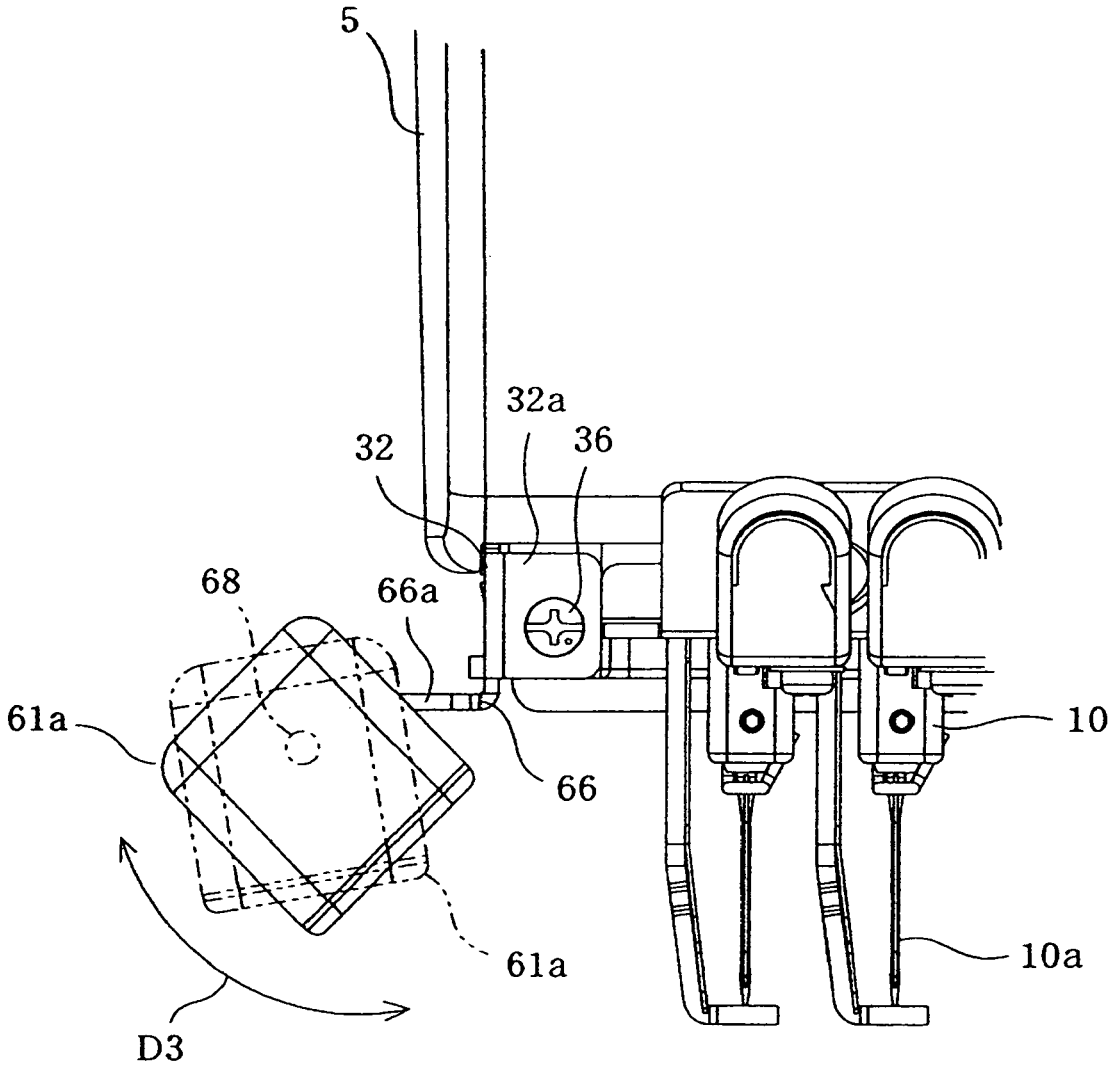
FIG. 15 is an enlarged front view the left illuminator and neighborhood thereof.

The illuminator 61*a* is supported by the second support mechanism 65 so as to be swingable in the direction of arrow D3 in FIG. 15 about a horizontal axis (the support bar 68). The illuminator 61*a* is held at any swinging position by the leaf spring 70. Thus, the illuminators 61*a* and 61*b* are supported by the second support mechanisms 65 and 65' so that the illumination angles α formed between the light axes and the periphery of needle hole P is adjustable. Accordingly, since the illuminators 61*a* and 61*b* are changed to respective attitudes the user desires, the usability of the illumination device can be improved.

The light source should not be limited to the chip LED 43 in each of the foregoing embodiments. For example, the light source may comprise another type of LED, a fluorescent lamp, incandescent lamp or the like.

The paired illuminators 27*a* and 27*b* (61*a* and 61*b*) are provided in each of the foregoing embodiments. More specifically, one, three or more of illuminators each arranged to maintain a predetermined illuminance near the needle drop position may be provided, instead. Furthermore, the illumination angle α should not be limited to 45 degrees but may be changed to another suitable value together with change in the illuminated area.

In each of the foregoing embodiments, the control device 8 reads a corresponding electric current value from the current value table according to the switched needle bar 10 thereby to control the drive circuits 48*a* and 48*b*. This control manner should not be restrictive. The control circuit may control a light adjusting circuit serving as a light adjusting unit with movement of the needle bar case 5 with the illuminating member by the needle bar case moving mechanism 25 so that a predetermined illuminance is maintained near the needle drop position.

The illuminance of each illuminator should not be limited to 300 Lx but may be changed to another suitable value.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. An illumination device for a multineedle sewing machine which includes a plurality of needle bars having lower ends to which needles are adapted to be attached respectively and a needle bar case supporting the needle bars so that the needle bars are movable upward and downward, and a needle bar case moving mechanism which moves the needle bar case so that one of the needle bars is selectively switched into a needle drop position, the needle bar case having a side formed along a moving direction thereof, the illumination device comprising:

an illuminating member having a light source and provided at a lateral side of the needle bar case, the illuminating member being disposed so as to open portions of the needle bars and portions of the needles, both portions being located at said side of the needle bar case respectively;

a light amount adjusting unit which adjusts an amount of light emitted from the light source; and a control unit which controls the light amount adjusting unit with movement of the needle bar case by the needle bar case moving mechanism together with the illuminating member so that a predetermined illuminance is maintained at least in part of an illuminated area which is illuminated by the light source, said part of the illuminated area being located near a needle drop position.

2. The illumination device according to claim 1, wherein the needle bar case is reciprocated and the plural illuminating members are provided at both sides to which the needle bar case is moved.

3. The illumination device according to claim 1, further comprising a first support mechanism which supports the illuminating member relative to the needle bar case, the first support mechanism including a supporting member which supports the illuminating member so that the illuminating member is swingable between an illuminating position where the illuminated area is illuminated by the light source and a retreat position differing from the illuminating position and an urging member which urges the illuminating member toward the illuminating position.

4. The illumination device according to claim 1, further comprising a second support mechanism which supports the illuminating member so that an attitude of the illuminating member is changeable relative to the needle bar case.

5. A multineedle sewing machine comprising a plurality of needle bars having lower ends to which needles are attached respectively, a needle bar case supporting the needle bars so that the needle bars are movable upward and downward, the needle bar case having a side defining a peripheral area along a moving direction thereof, a needle bar case moving mechanism which moves the needle bar case so that one of the needle bars is selectively switch into a needle drop position, and an illuminating device including an illuminating member having a light source and provided at a side to which the needle bar case is moved, the illuminating member being disposed so as to open part of the peripheral side where the needle bar and the needle are located;

a light amount adjusting unit which adjusts an amount of light of the light source; and a control unit which controls the light amount adjusting unit with movement of the needle bar case by the needle bar case moving mechanism together with the illuminating member so that a predetermined illuminance is maintained at least in part of an illuminated area which is illuminated by the light source, said part of the illuminated area being located near the needle drop position.

* * * * *